US010533740B2

(12) United States Patent
Shaw et al.

(10) Patent No.: US 10,533,740 B2
(45) Date of Patent: Jan. 14, 2020

(54) INWARD FIRED ULTRA LOW $NO_X$ INSULATING BURNER FLANGE

(71) Applicant: Carrier Corporation, Jupiter, FL (US)

(72) Inventors: Robert Shaw, Indianapolis, IN (US); Duane D. Garloch, Westfield, IN (US); Nicholas Kamm, Zionsville, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 35 days.

(21) Appl. No.: 15/204,599

(22) Filed: Jul. 7, 2016

(65) Prior Publication Data

US 2017/0009981 A1 Jan. 12, 2017

Related U.S. Application Data

(60) Provisional application No. 62/190,572, filed on Jul. 9, 2015.

(51) Int. Cl.

| | |
|---|---|
| ***F23C 5/02*** | (2006.01) |
| ***F23D 23/00*** | (2006.01) |
| ***F23C 5/08*** | (2006.01) |
| ***F23D 14/02*** | (2006.01) |

(52) U.S. Cl.

CPC ..... *F23C 5/02* (2013.01); *F23C 5/08* (2013.01); *F23D 14/02* (2013.01); *F23D 23/00* (2013.01)

(58) Field of Classification Search

CPC .... F23C 5/02; F23C 5/08; F23D 14/02; F23D 23/00

USPC ..... 431/343

See application file for complete search history.

(56) References Cited

U.S. PATENT DOCUMENTS

| | | | | |
|---|---|---|---|---|
| 2,336,816 | A | 12/1943 | Thompson | |
| 2,337,240 | A | 12/1943 | Harper et al. | |
| 3,981,142 | A | 9/1976 | Irwin | |
| 5,163,416 | A | 11/1992 | Schultz et al. | |
| 5,240,411 | A | 8/1993 | Abalos | |
| 5,511,516 | A | 4/1996 | Moore, Jr. et al. | |
| 6,735,949 | B1 * | 5/2004 | Haynes | F23R 3/283 60/746 |
| 7,780,437 | B2 | 8/2010 | Bernero et al. | |
| 8,281,598 | B2 | 10/2012 | Gerendas et al. | |
| 2002/0076669 | A1 | 6/2002 | Riepenhoff et al. | |
| 2005/0095547 | A1 * | 5/2005 | Pottenger | F23C 5/02 431/354 |
| 2009/0311641 | A1 | 12/2009 | Berthold et al. | |
| 2012/0196237 | A1 * | 8/2012 | Murray | F23D 14/46 431/354 |

(Continued)

FOREIGN PATENT DOCUMENTS

| | | | |
|---|---|---|---|
| DE | 19735512 | C1 | 2/1999 |
| DE | 19832131 | C1 | 12/1999 |
| DE | 20207906 | U1 | 9/2003 |

(Continued)

*Primary Examiner* — Steven B McAllister
*Assistant Examiner* — Allen R Schult
(74) *Attorney, Agent, or Firm* — Cantor Colburn LLP

(57) ABSTRACT

A collar configured to couple a burner to a partition plate is provided including a body having a diameter configured to couple to a diameter of the burner. A flange extends outwardly from the body. The collar is formed from a heat resistance material such that heat transfer between the burner and the partition plate is limited.

7 Claims, 10 Drawing Sheets

(56) References Cited

U.S. PATENT DOCUMENTS

| | | | | |
|---|---|---|---|---|
| 2012/0247444 | A1* | 10/2012 | Sherrow | F24H 9/14<br>126/116 R |
| 2017/0009982 | A1 | 1/2017 | Garloch et al. | |

FOREIGN PATENT DOCUMENTS

| | | | |
|---|---|---|---|
| DE | 10327391 | B3 | 12/2004 |
| DE | 10349836 | B3 | 4/2005 |
| DE | 102006049294 | A1 | 4/2008 |
| EP | 0230797 | B1 | 8/1991 |
| EP | 1568941 | A1 | 8/2005 |
| EP | 1582811 | A2 | 10/2005 |
| EP | 1696175 | A1 | 8/2006 |
| EP | 2037175 | A2 | 3/2009 |

* cited by examiner

INWARD FIRED ULTRA LOW $NO_X$ INSULATING BURNER FLANGE

CROSS-REFERENCE TO RELATED APPLICATION

This application claims the benefit of U.S. provisional patent application Ser. No. 62/190,572 filed Jul. 9, 2015, the entire contents of which are incorporated herein by reference.

BACKGROUND

The subject matter disclosed herein relates to heating systems. More specifically, the subject disclosure relates to burners for residential and commercial heating systems.

Heating systems, in particular furnaces, include one or more burners for combusting a fuel such as natural gas. Hot flue gas from the combustion of the fuel proceeds from the burner and through a heat exchanger. The hot flue gas transfers thermal energy to the heat exchanger, from which the thermal energy is then dissipated by a flow of air driven across the heat exchanger by, for example, a blower.

A typical prior art construction is shown in FIG. 1. A burner 100 is located external to a heat exchanger 102. The burner 100, often referred to as an inshot burner 100, receives a flow of fuel from a fuel source 104. An ignition source 106 combusts the flow of fuel to create a combustion flame 110.

Another type of burner is a premix burner in which fuel and air are mixed in a burner inlet tube prior to injection into a combustion zone 112 where the ignition source 106 ignites the mixture. Premix burners, compared to inshot burners, typically emit much lower levels of nitrogen oxide ($NO_x$), the emissions of which are tightly regulated and restricted by many jurisdictions. Because of this advantage of premix burners, it may be desirable to utilize premix burners in furnaces.

In multi-burner applications such as furnaces, each heat exchanger is typically supplied with hot combustion products by individual burners. Typically, each burner is mounted to a partition plate of the burner assembly with a metallic flange to direct the flow of hot combustion products towards the heat exchanger. As the flame exits each burner, the flame flows across each burner flange causing the flange to become hot. Due to the highly conductive nature of the flange, the heat of the flame is transferred to the partition plate via the flanges, resulting in damage and/or deformation of the partition plate.

BRIEF DESCRIPTION

According to one embodiment, a collar configured to couple a burner to a partition plate is provided including a body having a diameter configured to couple to a diameter of the burner. A flange extends outwardly from the body. The collar is formed from a heat resistance material such that heat transfer between the burner and the partition plate is limited.

In addition to one or more of the features described above, or as an alternative, in further embodiments the flange is receivable within an embossment formed in the partition plate.

In addition to one or more of the features described above, or as an alternative, in further embodiments the collar is formed from a ceramic material.

In addition to one or more of the features described above, or as an alternative, in further embodiments wherein the flange does not extend beyond a plane defined by an adjacent surface of the partition plate when the flange is positioned within the embossment.

In addition to one or more of the features described above, or as an alternative, in further embodiments the flange is arranged at an end of the collar.

In addition to one or more of the features described above, or as an alternative, in further embodiments the flange is arranged at a central portion of the body.

In addition to one or more of the features described above, or as an alternative, in further embodiments the flange is positioned within the embossment, a portion of the collar extends through an opening formed in the partition plate.

In addition to one or more of the features described above, or as an alternative, in further embodiments a portion of the body is received within a component coupled to the partition plate.

In addition to one or more of the features described above, or as an alternative, in further embodiments at least one opening is formed in the portion of the body. The at least one opening is configured to align with a carryover opening formed in the partition plate.

According to another embodiment, a burner assembly is provided including a plurality of burners. Each burner includes a burner tube having an inlet, and outlet, and a burner axis. A partition plate is arranged generally perpendicular to a horizontal plane defined by the plurality of burner axes. The partition plate includes a plurality of partition openings complementary to and arranged coaxially with the plurality of burners. A plurality of collars are mounted at the interface between each of the plurality of burners and a partition opening to limit heat transfer between the burner and the partition plate.

In addition to one or more of the features described above, or as an alternative, in further embodiments a retaining plate is mounted adjacent a surface of the partition plate. The retaining plate is configured to surround a portion of at least one of the plurality of collars to restrict movement of the at least one of the plurality of collars.

In addition to one or more of the features described above, or as an alternative, in further embodiments each of the plurality of collars comprises a body and a flange. The body has a diameter substantially equal to a diameter of one of the plurality of burners. The flange extends outwardly from the body and is receivable within an embossment formed in the partition plate.

In addition to one or more of the features described above, or as an alternative, in further embodiments the flange does not extend beyond a plane defined by an adjacent surface of the partition plate when the flange is positioned within the embossment.

In addition to one or more of the features described above, or as an alternative, in further embodiments the flange is arranged at an end of the collar body.

In addition to one or more of the features described above, or as an alternative, in further embodiments the flange is arranged at a central portion of the collar body.

In addition to one or more of the features described above, or as an alternative, in further embodiments a portion of the body extends through an opening formed in the partition plate.

In addition to one or more of the features described above, or as an alternative, in further embodiments at least one opening is formed in the portion of the body, the at least one opening being configured to align with a carryover opening formed in the partition plate.

These and other advantages and features will become more apparent from the following description taken in conjunction with the drawings.

BRIEF DESCRIPTION OF THE DRAWINGS

The subject matter, which is regarded as the present disclosure, is particularly pointed out and distinctly claimed in the claims at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION OF THE INVENTION

Figure 1:
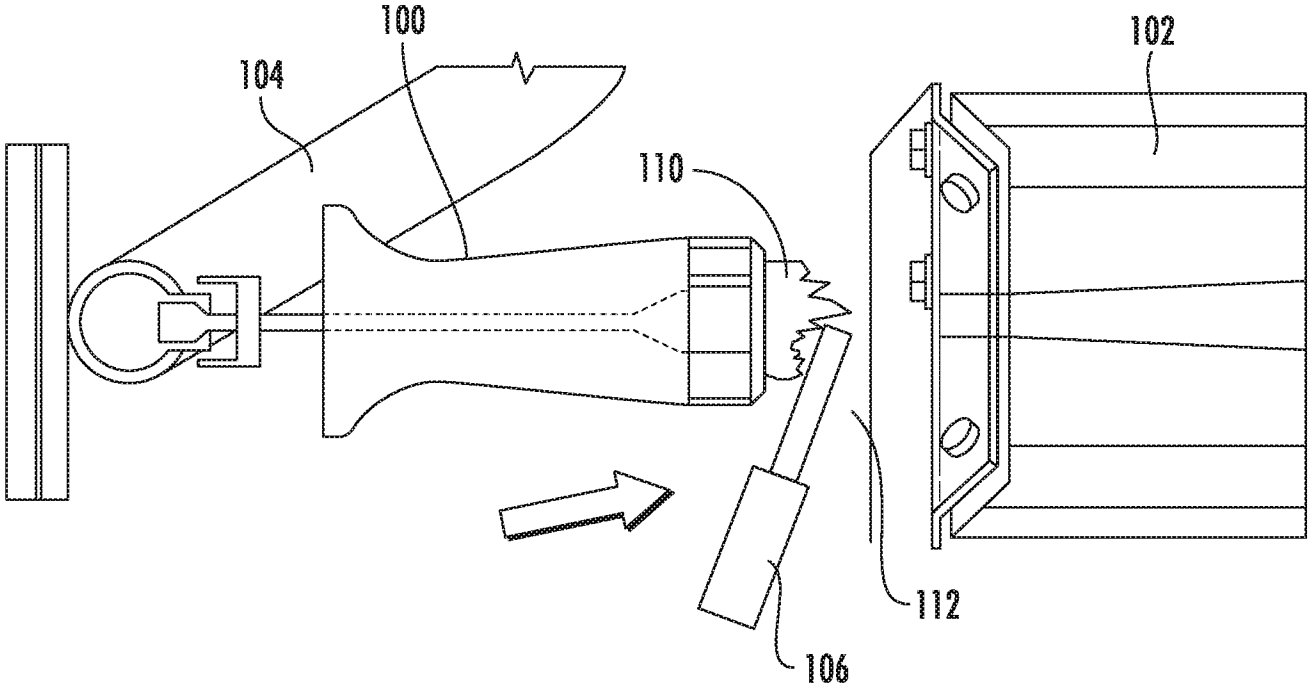
FIG. 1 (PRIOR ART)
FIG. 1 is a side view of an example of a typical prior art burner arrangement.
Figure 2:
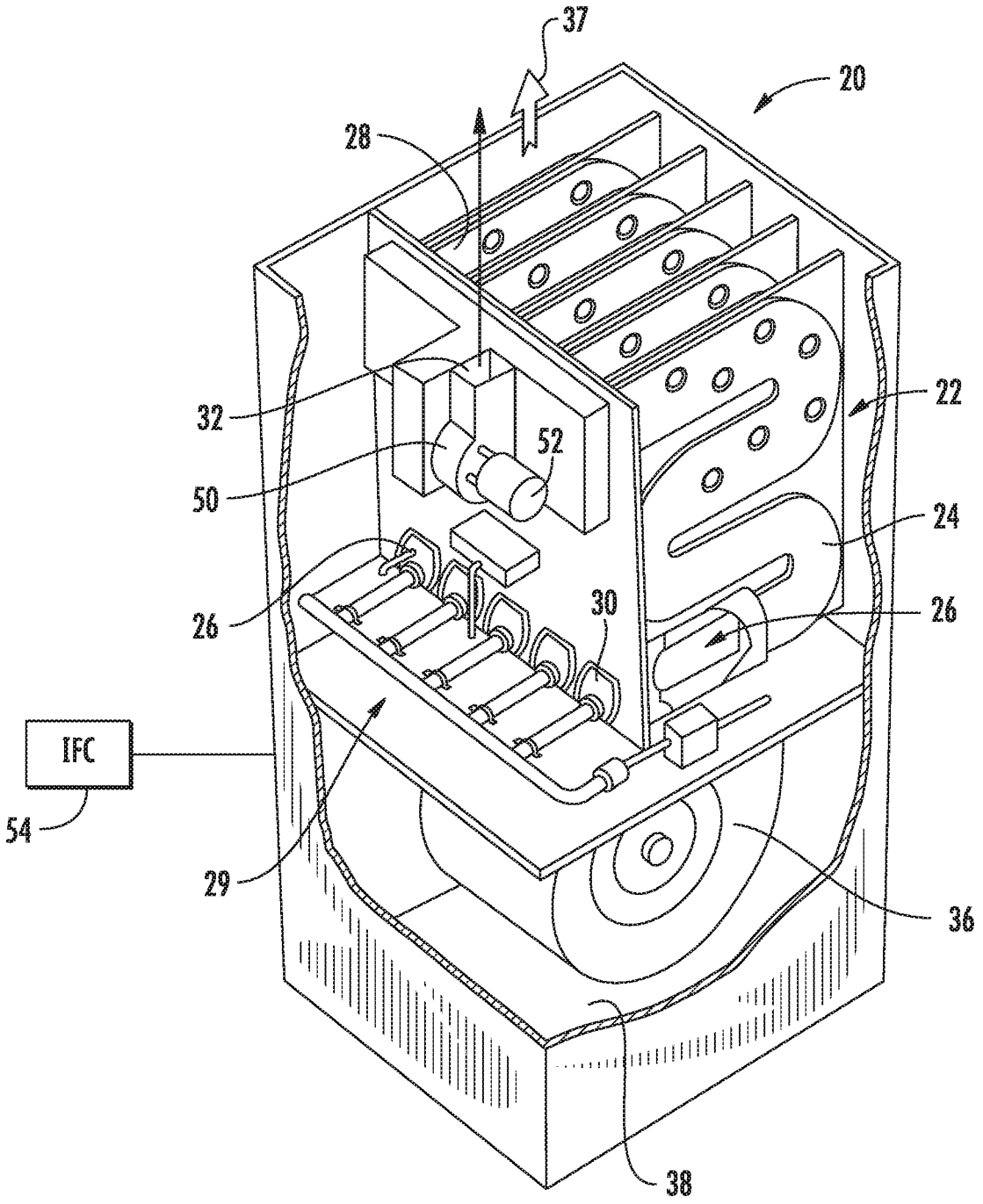
FIG. 2 is a schematic view of an embodiment of a furnace.

Referring now to FIG. 2, an improved furnace 20 is illustrated. The furnace 20 may include a heat exchanger 22 having a plurality of individual heat exchanger coils 24. The heat exchanger coils or cells 24, which may be metallic conduits, may be provided in a serpentine fashion to provide a large surface area in a small overall volume of space. Each heat exchanger cell 24 includes an inlet 26 and outlet 28. A burner assembly 29 includes a burner 30 (FIG. 3) operatively associated with each inlet 26, and a vent 32 operatively associated with each outlet 28. The burner assembly 29 introduces a flame and combustion gases (not shown) into the heat exchanger cell 24, while vent 32 releases the combustion gases to atmosphere (through a flue or the like) after the heat of the flame and combustion gases is extracted by the heat exchanger 22.

In order to extract the heat, an indoor blower assembly 36 may be provided to create a significant air flow across the heat exchanger cells 24. As the air circulates across the cells 24, it is heated and can then be directed to a space to be heated, such as a home or commercial building for example, by way of appropriate ductwork as indicated by arrow 37. The furnace 20 may also include a return 38 to enable air from the space to be heated to be recirculated and/or fresh air to be introduced for flow across the heat exchanger cells 24.

Figure 3:
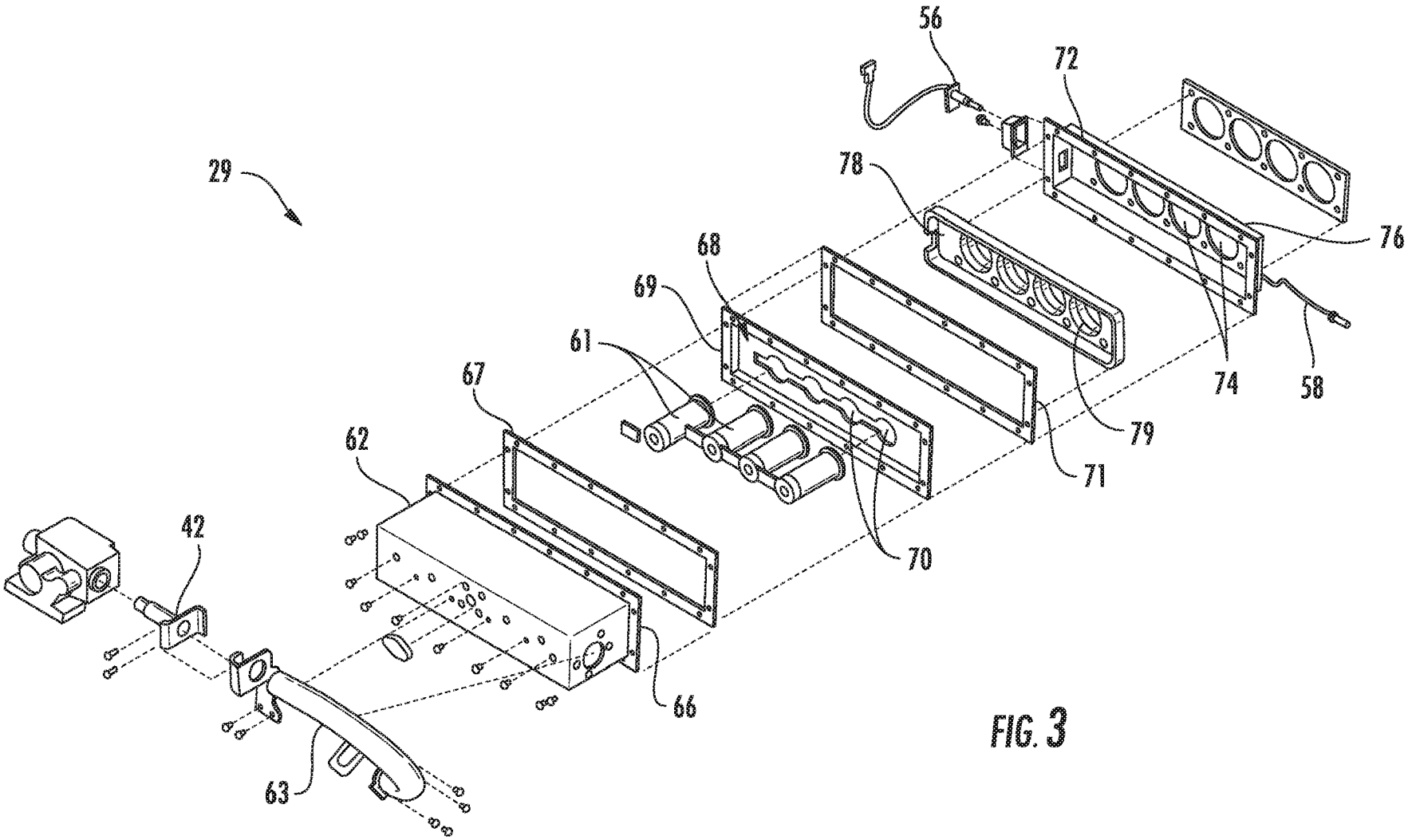
FIG. 3 is an expanded view of a burner box according to an embodiment of the present disclosure.
Figure 6:
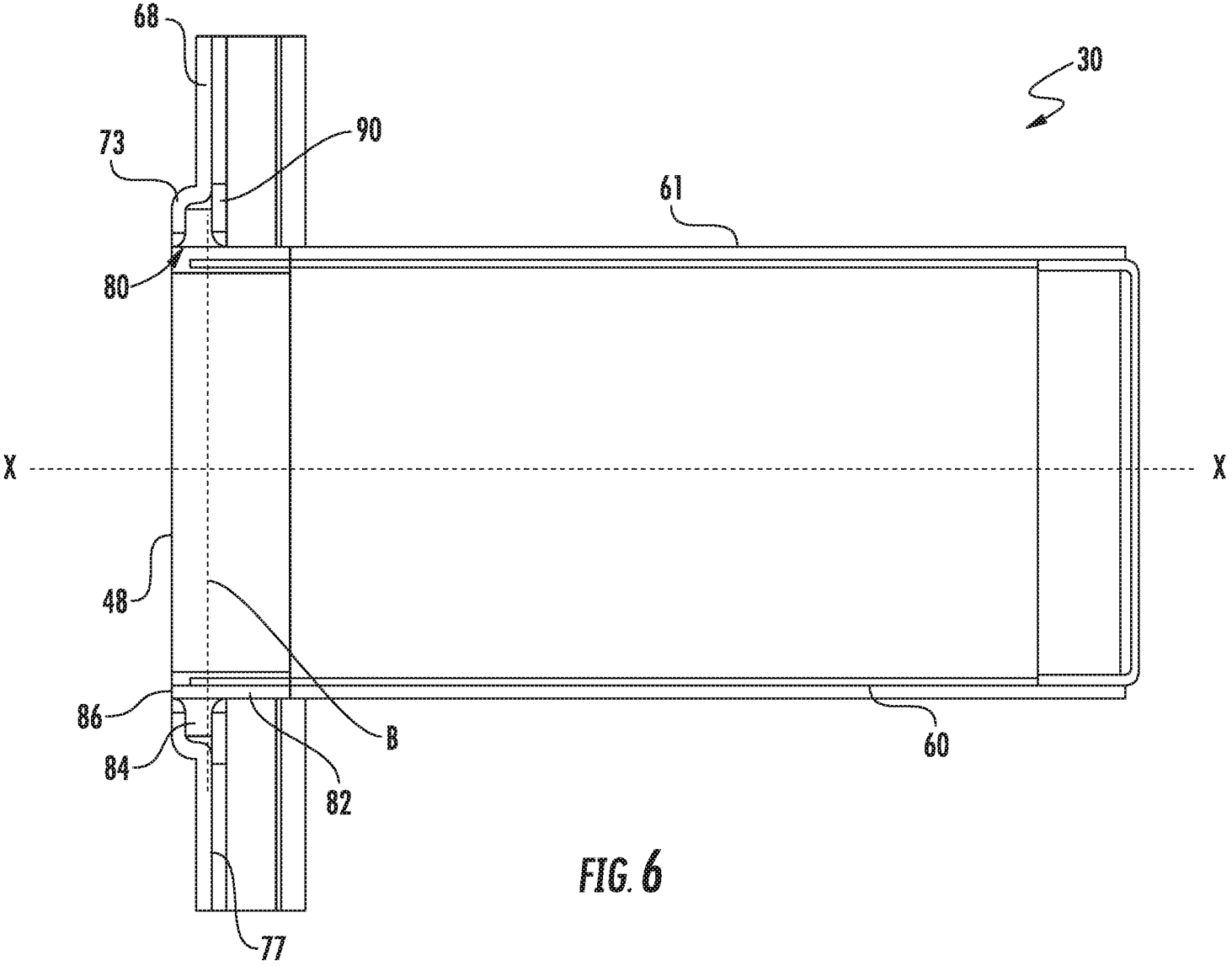
FIG. 6 is a cross-sectional view of a burner mounted to a partition plate with the collar of FIG. 5.

Referring now to FIGS. 2, 3, and 6, to generate the flame and hot combustion gases, the burners 30 pre-mix fuel and air and then ignite the same. The fuel may be natural gas, propane, or any other suitable fuel, and may be introduced by a fuel orifice, jet 42, or any other suitable means (FIG. 3) positioned at an inlet of a burner inlet tube 63, or elsewhere in the air intake system. A portion or substantially all of the air and fuel for combustion is introduced into the burners 30 through inlet 63. Referring back to FIG. 2, air may be introduced by inducing an airflow using a motorized induction fan 50 downstream of a burner outlet 48 (FIG. 6). More specifically, a motor 52 having the fan 50 associated therewith may be operatively associated with the outlets 28 of the heat exchanger cells 24. When energized, the fan 50 may rotate and induce an air flow through the heat exchanger cells 24 and burners 30. Control of the motor 52, may be controlled by a processor 54 such as an integrated furnace control (IFC).

Referring now to FIGS. 3-6, the burner assembly 29 is illustrated in more detail. As indicated above, each burner 30 includes a burner tube 61 having an inlet 60 formed generally about a circumference thereof and an outlet 48. However, the burner tube 61 may be provided in other configurations as well. For example, while depicted as a cylindrical tube of constant diameter, the burner tube 61 may be provided as a restricted diameter section or a venturi, among other variations.

At least a portion, or all, of the plurality of burners 30 may be arranged within an interior mixing chamber (not shown) of an outer box 62. Fuel supplied by the fuel jet 42 and air drawn by inducer fan 50 are premixed and supplied to the mixing chamber prior to ignition. The burners 30 may additionally include a mixer (not shown) which is used to decrease lean blow-off and increase the stability of the flame. To light the burners 30, at least one igniter 56 is located near the burners 30, generally between the burner outlet 48 and the heat exchanger inlet 26 to ignite the fuel/air mixture. A flame sensor 58 may be mounted adjacent one or more of the burners 30 to detect that fuel/air mixture therein has been ignited.

The burners 30 are positioned within the mixing chamber (not shown) such that the outlet 48 of the burner 30 is adjacent an open end 66 of the box 62. Connected to the open end 66 of the box 62 and the outlet end 48 of each of the plurality of burners 30 is a partition plate 68. A gasket 67 may be arranged between a portion of the open end 66 of box 62 and an outer flange 69 of the partition plate 68 to provide a seal there between. The partition plate 68 has a plurality of openings 70 formed therein, each of which is substantially aligned with and fluidly coupled to the outlet 48 of a corresponding burner 30. In another embodiment, a portion of the burner tubes 61 may extend through the openings 70 formed in the partition plate 68.

An inner box 72 is coupled to the partition plate 68, opposite the outer box 62. A gasket 71 may similarly be arranged between a portion of the partition plate 68 and the inner box 72 to form a seal there between. In an embodiment, the inner box 72 may be integrated with the partition plate 68. The inner box 72 also includes a plurality of openings 74, each of which is substantially aligned with and fluidly coupled to an opening 70 formed in the partition plate 68 and the outlet 48 of a corresponding burner 30. The individual heat exchanger cells 24 are positioned adjacent an exterior surface 76 of the inner box 72, in line with the plurality of openings 74, such that a fluid flow path extends from the burner outlet 48 through the partition plate 68 and inner box 72 into the heat exchanger cells 24. In the illustrated, non-limiting embodiment of FIG. 3, a refractory panel 78 is arranged between a portion of the partition plate 68 and the inner box 72. The refractory panel 78 is configured to protect not only the adjacent surface of the inner box 72, but also the interface between the inner box 72 and the heat exchanger cells 24, from overheating. As shown in the expanded view of FIG. 3, the refractory panel 78 includes a plurality of openings 79, each of which is substantially aligned with and fluidly coupled to an opening 70, 74 of the partition plate 68 and inner box 72, respectively.

Figure 4:
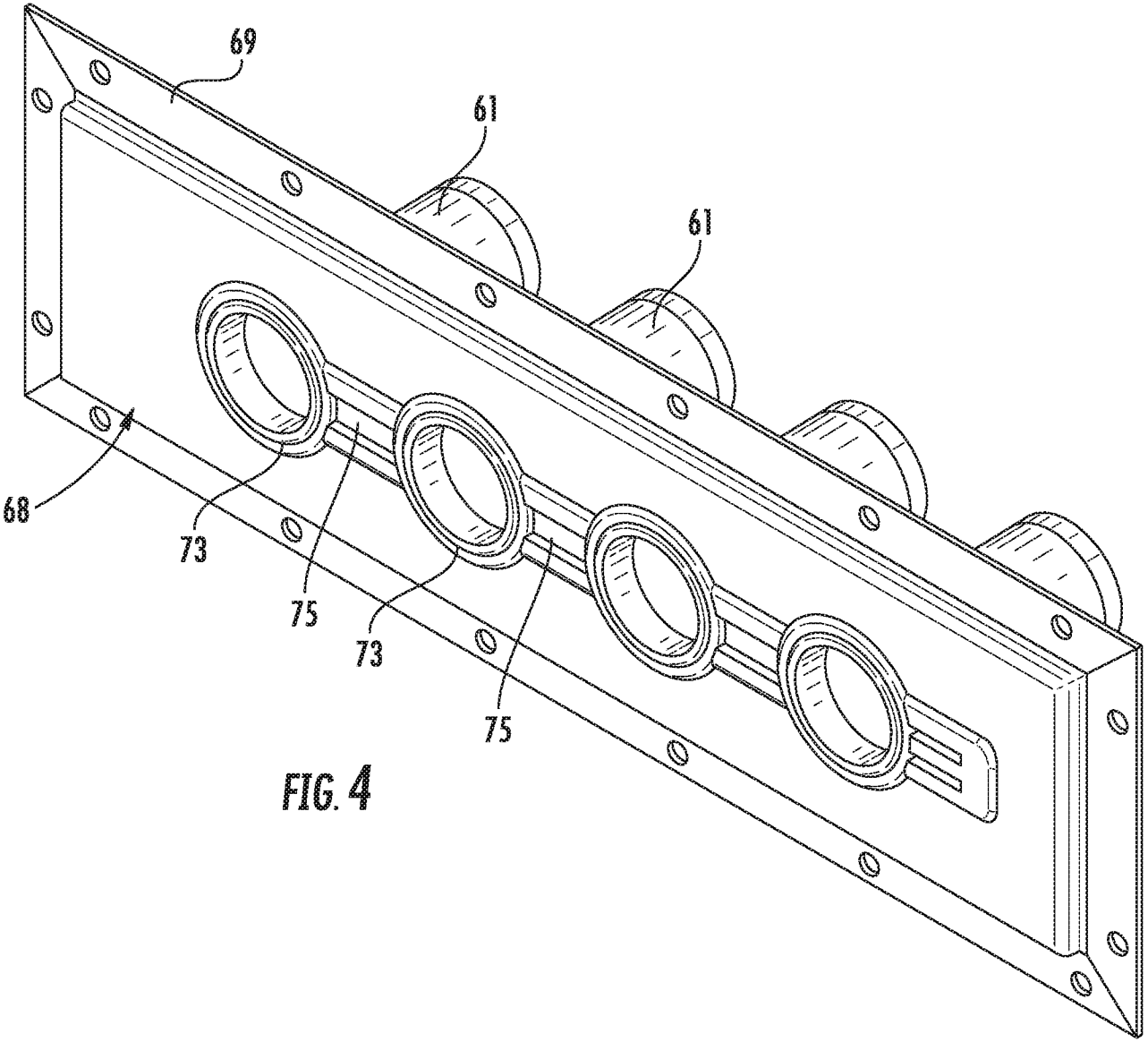
FIG. 4 is a perspective view of a plurality of burners mounted to a partition plate.
Figure 5:
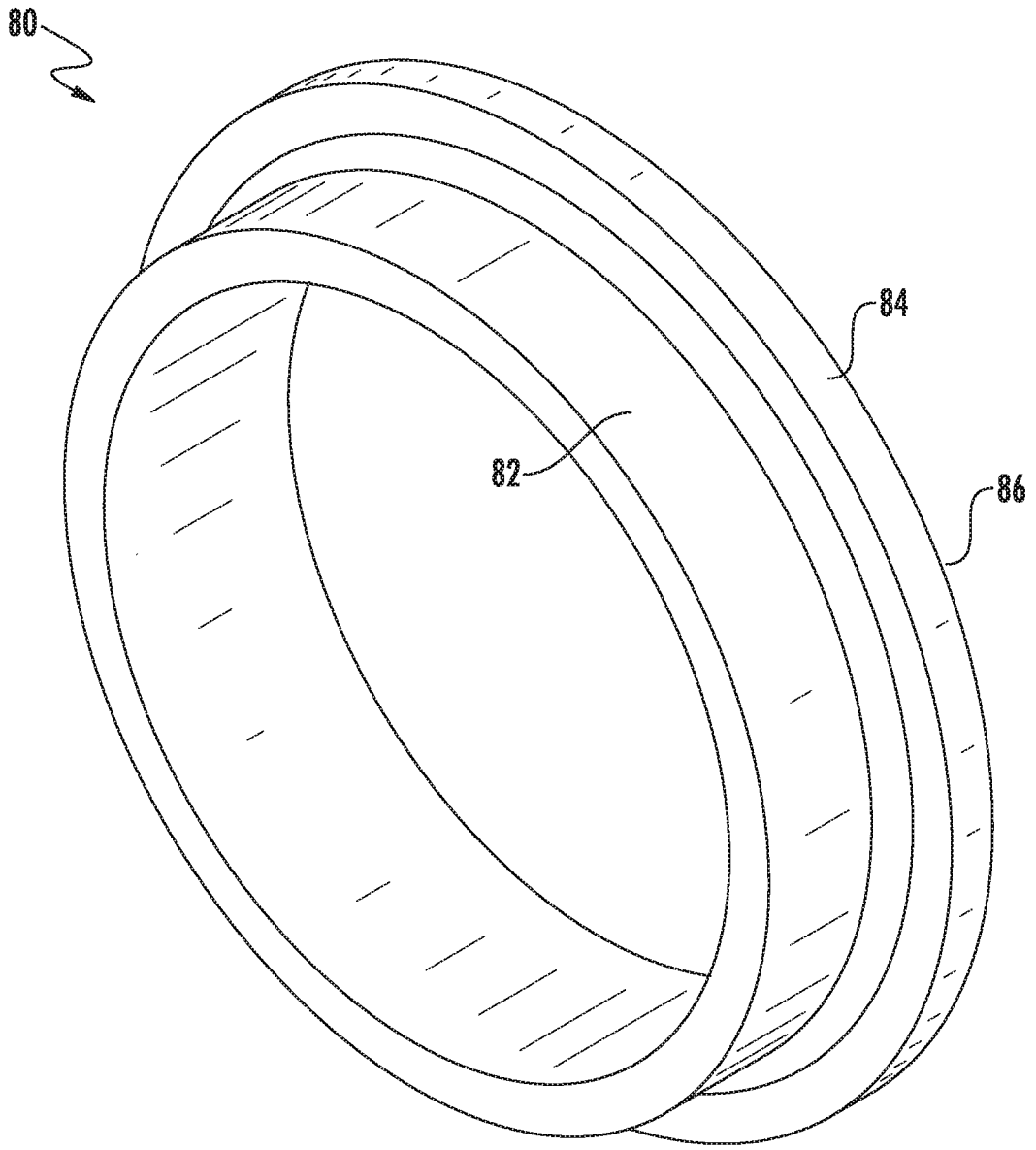
FIG. 5 is a perspective view of an example of a collar configured to mount a burner to the partition plate.

With reference now to FIGS. 4-10, a collar 80 is removably or fixedly mounted about a surface of at least one of the burner tubes 61. As shown, for example, in FIG. 6, a flange 84 extending outwardly from a body 82 of the collar 80 is used to mount the burner tube 61 to the partition plate 68 (FIG. 4). For example, the inner diameter of the burner tube 61 may be generally complementary to an outer diameter of the collar body 82. Alternatively, the outer diameter of the burner tube 61 may be generally complementary to an inner diameter of the collar body 82. In the illustrated, non-limiting embodiment of FIG. 6, the collar 80 is arranged such that the flange 84 is positioned generally adjacent the outlet end 48 of the burner tube 61. However, embodiments where the flange 84 is arranged at another position along the burner tube 61, spaced away from the outlet end 48 by a distance, are also within the scope of the disclosure. The collar 80 may be formed from a heat resistant material, such as a ceramic or plastic for example, configured to withstand temperatures up to and exceeding 2300° F. The material of the collar 80 and the material of the burner tube 61 may, but need not be, the same.

Figure 8:
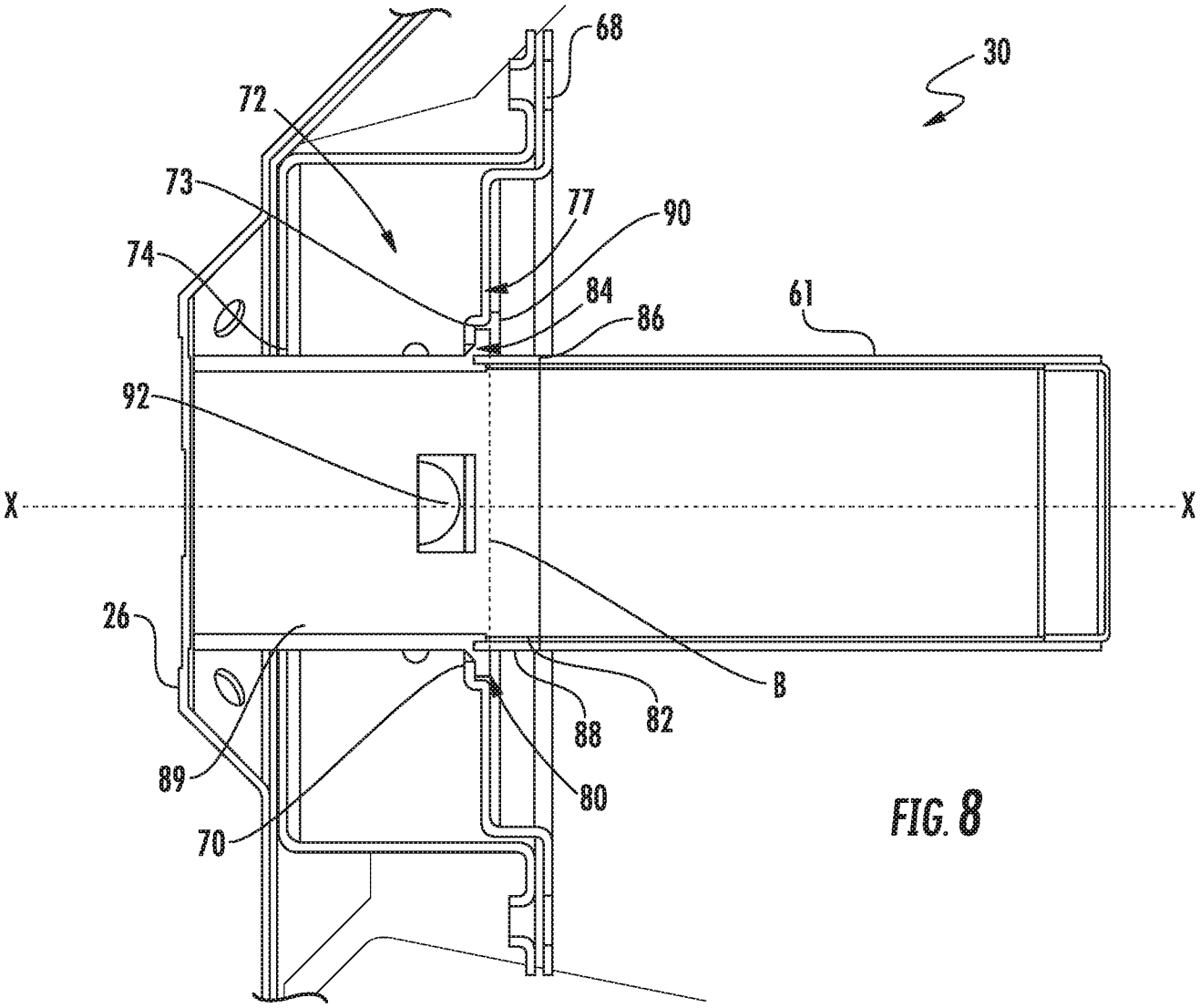
FIG. 8 is a cross-sectional view of a burner mounted to a partition plate with the collar of FIG. 7.
Figure 9:
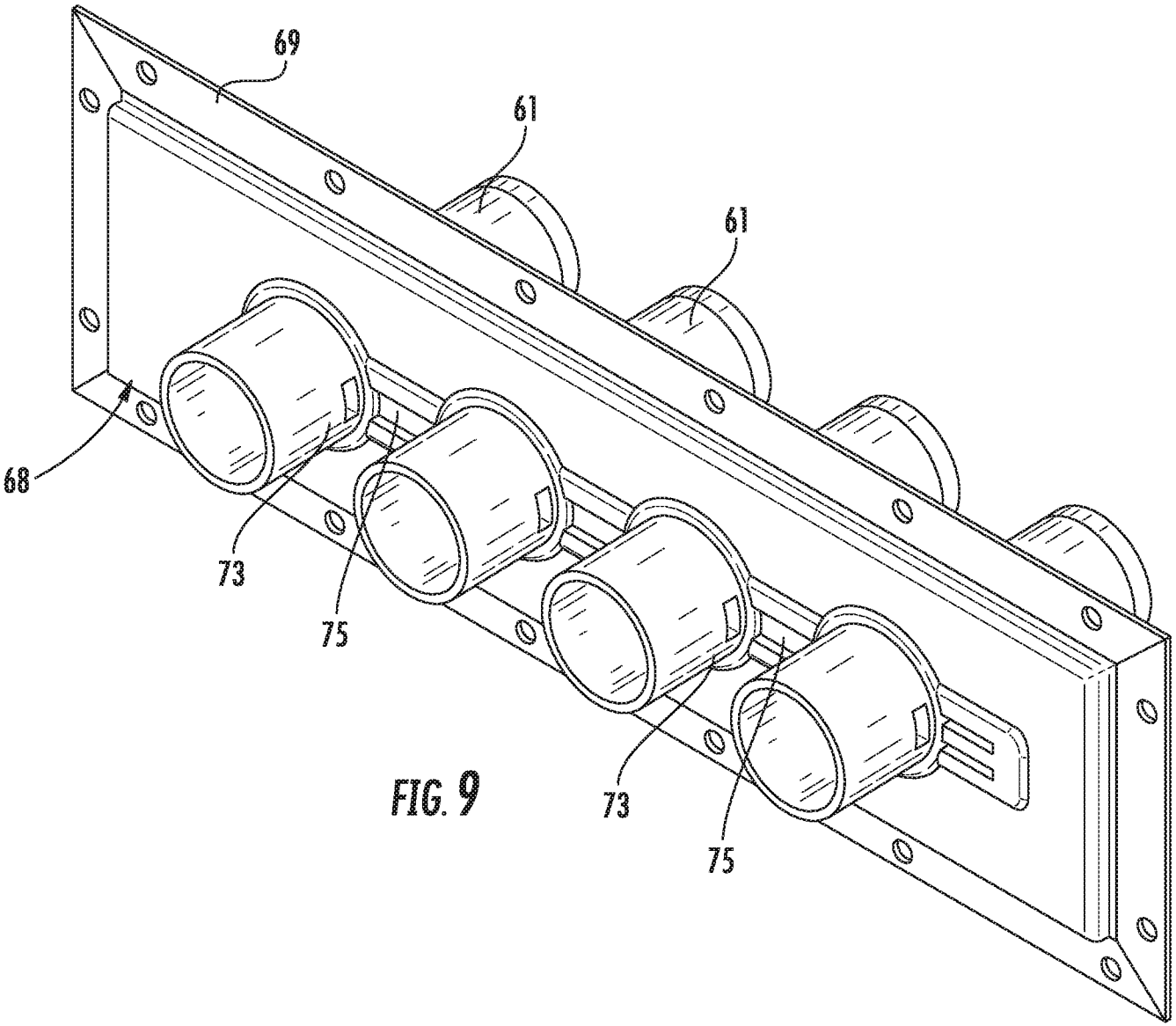
FIG. 9 is a perspective view of a plurality of burners mounted to a partition plate via the collars of FIG. 8.

Referring again to FIG. 4, the size and shape of the flange 84 (FIG. 5) may be similar to the shape and size of an embossment 73 formed in the partition plate 68. As a result, when the burner tube 61 is mounted to the partition plate 68, at least a portion of the flange 84 (FIG. 5) is received within the embossment 73. In one embodiment, as illustrated in FIGS. 6 and 8, a thickness of the flange 80 is less than the depth of the embossment 73, such that when the flange 84 (FIG. 5) is positioned within the embossment 73, the flange 84 does not protrude beyond a plane B defined by an adjacent surface 77 of the partition plate 68. In another embodiment, a thickness of the flange 84 is greater or equal to the depth of the embossment 73, such that when the flange 84 is positioned within the embossment 73, the flange 84 protrudes beyond or is level with a plane B defined by an adjacent surface 77 of the partition plate 68.

A retaining plate 90 (see FIG. 10), may be configured to mount to the surface 77 of the partition plate 68 to couple the burner tubes 61 thereto. The retaining plate 90 engages at least a portion of a first surface 82 of the flange 80 and the embossment 73 contacts at least a portion of a second surface 84. By positioning the retaining plate 90 and an embossment 73 of the partition plate 68 adjacent opposing sides of the flange 80 of a burner tube 61, translational movement of the burner tube 61 along the burner axis X, away from the partition plate 68, is restricted.

With reference now to the non-limiting embodiment of the collar 80 illustrated in FIGS. 3-6, the flange 84 is positioned generally adjacent an end 86 of the body 82. As a result, when the flange 84 of the collar 80 is mounted within an embossment 73 of the partition plate 68, the collar body 82 extends from the flange 84 in only a first direction, towards outer box 62 (FIG. 3).

Figure 7:
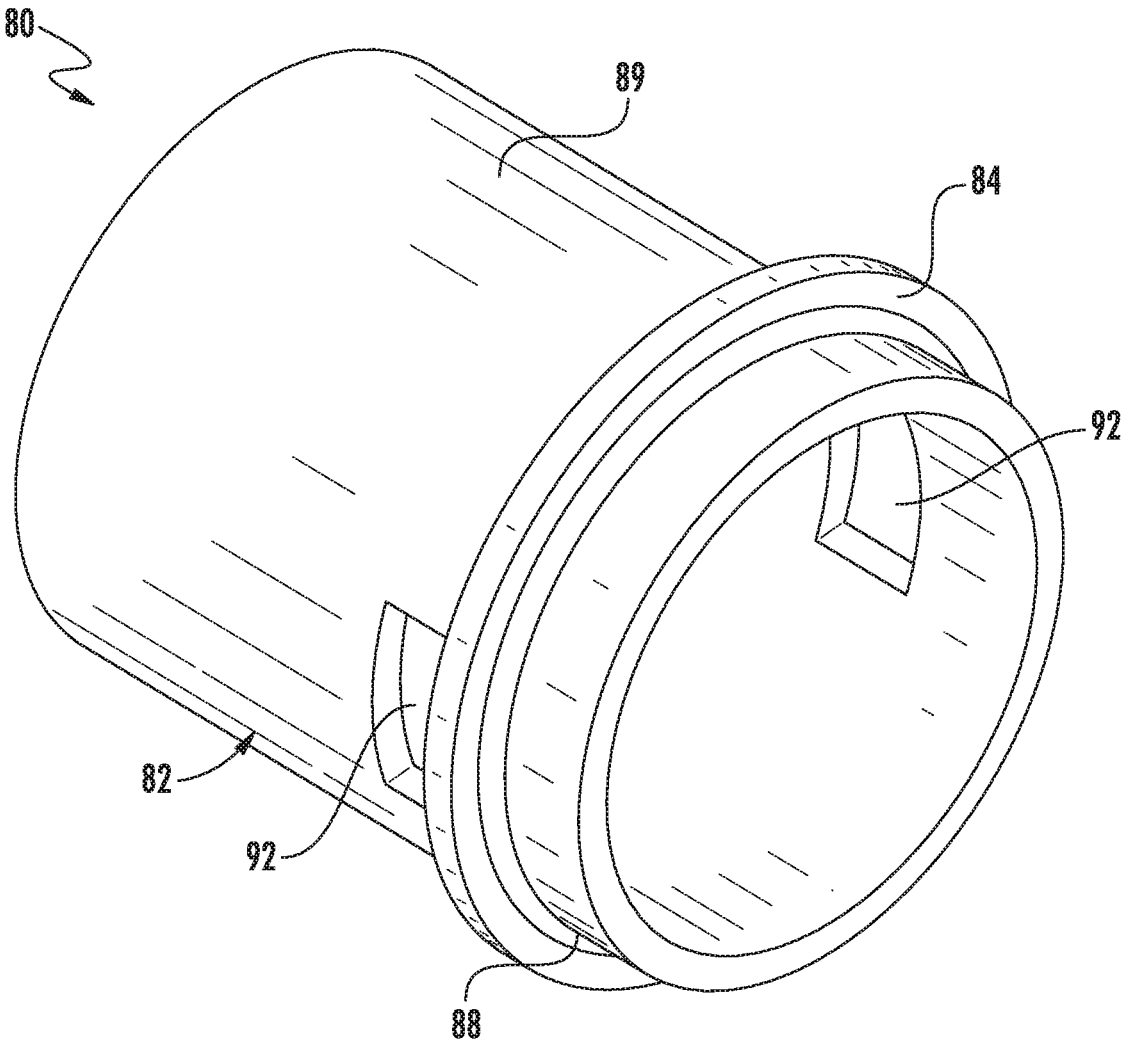
FIG. 7 is a perspective view of another collar configured to mount a burner to the partition plate.

In another embodiment, shown in FIGS. 7 and 8, the flange 84 is positioned away from the ends of the collar body 82. As a result, a first portion 88 the body 82 extends from the flange 84 in a first direction, and a second portion 89 of the body 82 extends from the flange 84 in a second direction. When the flange 84 is positioned within the embossment 73 (FIG. 4) of the partition plate 68, the first portion 88 of the collar body 82 extends toward the outer box 62 (FIG. 3) as previously described. The second portion 89 of the body 82 is configured to extend through a corresponding opening 70 formed in the partition plate 68 (FIG. 4), in a direction towards the heat exchanger 22 (FIG. 2). In one embodiment, the second portion 89 of the body 82 is received within an opening 79 (FIG. 3) of the refractory panel 78 (FIG. 3) to provide a continuous fluid flow path from the burner tube 61 to the heat exchanger inlet 26 (FIG. 2). For example, the contour of the openings 79 (FIG. 3) may be generally complementary to an outer diameter of the second portion 89 of the collar body 82. The second portion 89 may extend through an opening 74 (FIG. 3) formed in the inner box 72 (FIG. 3) to directly abut an end of each of the heat exchanger cells 24 (FIG. 2).

The second portion 88 of the collar body 82 may additionally include one or more openings 92, for example located near the flange 84. The at least one opening 92 is configured to align with one or more carryover openings 75 (see FIGS. 3 and 4) formed in the partition plate 68 (FIG. 4) between embossments 73 (FIG. 4). At least one opening 92 may comprise a single hole or a plurality of holes configured to overlap with at least a portion of an adjacent carryover opening 75 (FIG. 4). In the illustrated, non-limiting embodiment of FIG. 7, two substantially identical openings 92 are spaced equidistantly about a periphery of the portion 88 of the body 82. In addition, at least one of the collar 80 and the partition plate 68 (FIG. 4) may include a feature, such as a post for example, to position the flange 84 within a corresponding embossment 73 (FIG. 4) such that the openings 92 in the collar 80 are substantially aligned with the carryover openings 75 (FIG. 4) in the partition plate 73 (FIG. 4).

Figure 10:
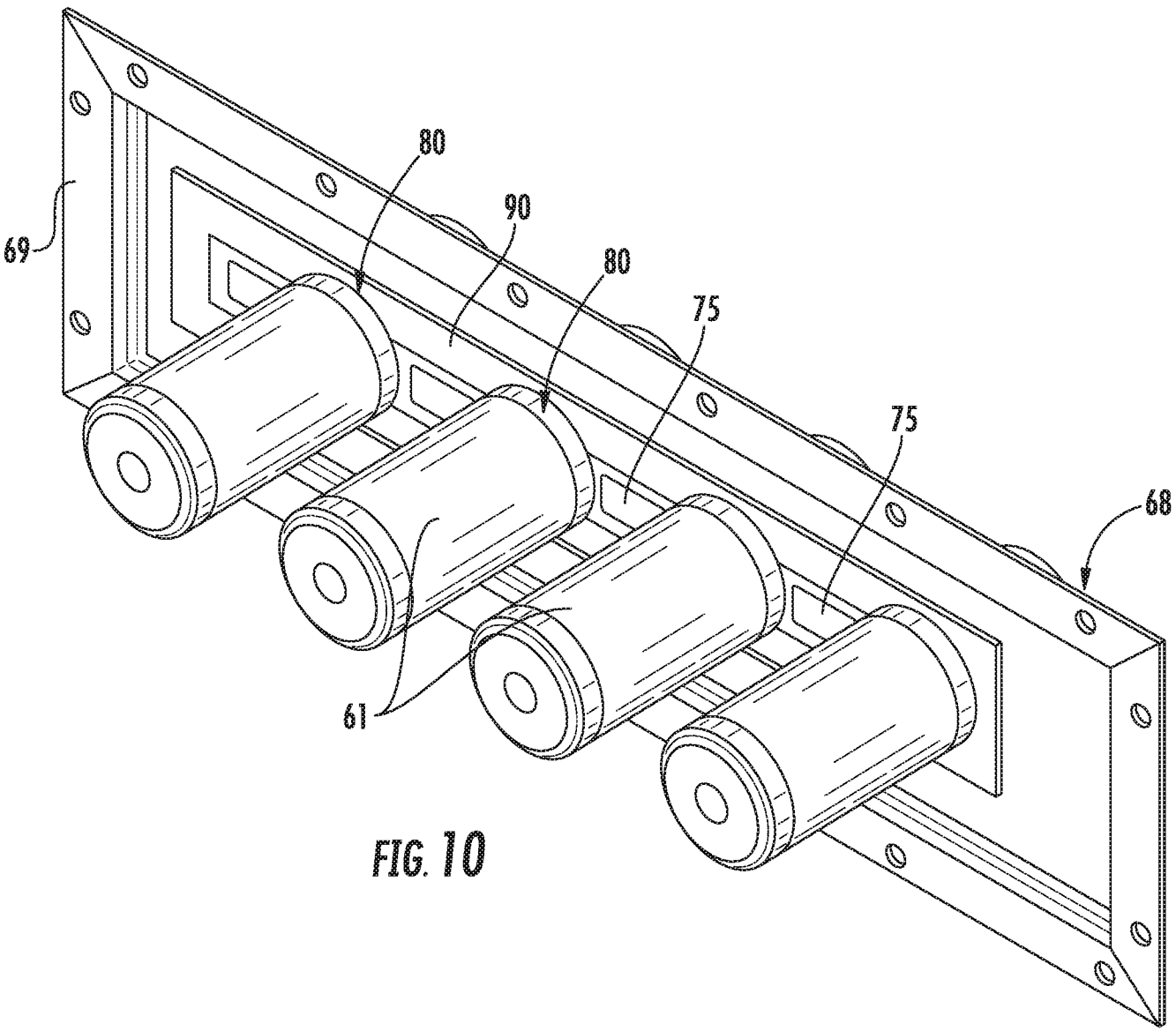
FIG. 10 is an alternate perspective view of a plurality of burners mounted to a partition plate via the collars of FIG. 8.

FIG. 10, depicts another view of the burner assembly and retaining plate 90. In the illustrated, non-limiting embodiment, the retaining plate 90 includes at least one opening having a diameter equal to or greater than a diameter of a burner tube 61 such that the burner tube 61 may be received therein. However, a retaining plate 90 having another configuration is also within the scope of the disclosure.

By positioning the collar 80 between the burners 30 (FIG. 3) and the partition plate 68 (FIG. 3), the collars 80 may protect not only the partition plate 68 (FIG. 3), but also the adjacent gaskets 67 (FIG. 3) and the inner box 72 and refractory panel 74 (FIG. 3) from overheating.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A burner assembly, comprising:

a plurality of burners, each burner including a burner tube having an inlet and an outlet and a burner axis;

a partition plate arranged generally perpendicular to a horizontal plane defined by the plurality of burner axes, the partition plate including a plurality of partition openings complementary to and arranged coaxially with the plurality of burners, the partition plate having an embossment extending toward a downstream surface thereof adjacent each of the plurality of partition openings; and a plurality of collars, each collar being mounted concentrically with a corresponding burner tube of the plurality of burners, between one of the plurality of burner tubes and a partition opening of the plurality of partition, each collar including a radially extending flange disposed within the embossment adjacent each of the plurality of partition openings; and a retaining plate mounted adjacent the flange of each collar of the plurality of collars, the retaining plate being positioned upstream from the flange relative to a flow through the burner tube, and opposite the partition plate such that the movement of the flange is restricted by the partition plate and the retaining plate;

wherein a portion of both the collar and the burner tube is located between the embossment and a plane defined by an upstream surface of the partition plate.

2. The burner assembly according to claim 1, wherein each of the plurality of collars comprises:

a body having an inner diameter substantially equal to an outer diameter of one of the plurality of burners.

3. The burner assembly according to claim 2, wherein when the flange is positioned within the embossment, the flange does not extend beyond a plane defined by an adjacent surface of the partition plate.

4. The burner assembly according to claim 2, wherein the flange is arranged at an end of the collar body.

5. The burner assembly according to claim 2, wherein the flange is arranged along a central portion of the collar body.

6. The burner assembly according to claim 5, wherein a portion of the body extends through an opening formed in the partition plate.

7. The burner assembly to claim 6, wherein at least one opening is formed in the portion of the body, the at least one opening being configured to align with a carryover opening formed in the partition plate.

* * * * *